US011808538B2

(12) United States Patent
Deeter

(10) Patent No.: US 11,808,538 B2
(45) Date of Patent: Nov. 7, 2023

(54) FIREARM BARREL AND INTERNALS SAVER AND METHOD OF USE

(71) Applicant: Blue Line Firearms LLC, Lebanon, IN (US)

(72) Inventor: Darrick Deeter, Lebanon, IN (US)

( * ) Notice: Subject to any disclaimer, the term of this patent is extended or adjusted under 35 U.S.C. 154(b) by 0 days.

(21) Appl. No.: 17/534,725

(22) Filed: Nov. 24, 2021

(65) Prior Publication Data

US 2022/0244007 A1 Aug. 4, 2022

Related U.S. Application Data

(60) Provisional application No. 63/118,462, filed on Nov. 25, 2020.

(51) Int. Cl.
*F41A 17/54* (2006.01)
*F41A 35/04* (2006.01)

(52) U.S. Cl.
CPC ..... *F41A 17/54* (2013.01); *F41A 35/04* (2013.01)

(58) Field of Classification Search
CPC ..... F41A 17/54; F41A 35/02; F41A 35/04
See application file for complete search history.

(56) References Cited

U.S. PATENT DOCUMENTS 2,558,792 A * 7/1951 Snowden ..... F41A 35/04 89/31
2,893,152 A 10/1955 Peluso
2,884,172 A * 4/1959 Kubo ..... F41C 33/00 224/913
3,022,596 A 5/1960 Cannon
3,063,184 A * 11/1962 Sukala, Jr. ..... F41A 35/04 42/106
3,616,559 A 11/1971 Sobolewski
4,280,644 A * 7/1981 Shindelka ..... F41C 33/002 42/96
4,509,281 A 4/1985 Dreiling
4,916,842 A 4/1990 Hardy
5,054,222 A 10/1991 Hardy
5,283,971 A 2/1994 Fuller
5,960,575 A * 10/1999 Chiovitt ..... F41A 17/54 42/70.07
6,019,404 A * 2/2000 Pasquale ..... F41A 17/44 294/219
6,398,089 B1 6/2002 Har-Shen
7,258,259 B1 8/2007 Owens
(Continued)

FOREIGN PATENT DOCUMENTS

CH 87397 A * 11/1920
WO WO-0046566 A1 * 8/2000 ..... F41A 35/04

OTHER PUBLICATIONS

Quartermaster. <https://web.archive.org/web/20200805024214/https://qmi.be/en/canvas-sling-muzzle-cover-60mm-mortar.html>. Aug. 5, 2020. (Year: 2020).*

*Primary Examiner* — Gabriel J. Klein
(74) *Attorney, Agent, or Firm* — Overhauser Law Offices LLC

(57) ABSTRACT

A firearm barrel and internals saver keeps debris, foreign objects, and free air out of a firearm. The trigger cover may be clipped on to the trigger guard of a firearm. An elastic connective member has a barrel cover at the opposite end, which fits over and covers the opening of the barrel of the firearm. Both the firearm barrel cover and internals saver are quickly removable for use in the field.

7 Claims, 5 Drawing Sheets

(56) References Cited

U.S. PATENT DOCUMENTS

| | | | | |
|---|---|---|---|---|
| 9,322,605 | B1 | 4/2016 | Noyons et al. | |
| 9,841,250 | B1 * | 12/2017 | Mirza | F41A 17/32 |
| 10,132,585 | B2 | 11/2018 | Harper et al. | |
| 2005/0205624 | A1 | 9/2005 | French et al. | |
| 2008/0221580 | A1 | 9/2008 | Miller | |
| 2012/0286005 | A1 | 11/2012 | Farnlacher et al. | |
| 2013/0061502 | A1 | 3/2013 | Derman | |
| 2014/0190602 | A1 * | 7/2014 | Utech | F41A 35/02 150/154 |
| 2014/0263497 | A1 * | 9/2014 | Visalli | F41C 33/0227 42/70.11 |
| 2016/0341519 | A1 | 11/2016 | Gaiser | |
| 2017/0227316 | A1 * | 8/2017 | Harper | F41A 17/54 |

* cited by examiner

FIREARM BARREL AND INTERNALS SAVER AND METHOD OF USE

FIELD OF THE INVENTION

The present invention relates to protective devices for firearms, and in particular, protection of the barrel and internals from dust, debris, foreign objects, and free air exposure and a method of use.

BACKGROUND

For over a hundred years, methods have been devised for protecting guns from the elements, to keep their action mechanisms in good working order at a moment's notice. Leverich's 1862 "Improvement in Covers for Gun-Locks" (U.S. Pat. No. 35,456) utilized a tube of India-rubber fabric secured by elastic banded ends to retard the development of rust on the action. Other concerns in the early days included keeping gunpowder dry. While those problems have largely been resolved by advances in metallurgy and cartridge technology, the issues of protection from the elements have remained in the modern era.

For example, police officers carrying their service weapons in their vehicles often keep them stored with the barrel facing up. This can lead to foreign particles including dust and debris entering the barrel which can affect the mechanics of the gun. Further, free air can enter the barrel and dry out the lubrication within the gun. It is therefore desirable to provide a protective device that covers the end of the barrel and protects the internals of the gun.

SUMMARY OF THE INVENTION

One object of the present invention is to protect the barrel and internals of the firearm. The invention accomplishes this goal by covering the two major areas where a firearm can gather dust, debris, or foreign objects—the trigger guard and the barrel. The invention contains a trigger cover that is clipped on to the trigger guard and at least one elastic connective member that attaches to the trigger guard. Further, the invention contains a waterproof barrel cover attached to the opposite end(s) of the elastic connective member(s) and stretched to fit over the end of the barrel. The waterproof barrel cover also optionally contains an interior layer to further protect against dust and debris.

This allows a user to clean their gun less frequently without a detrimental effect to the mechanics of the gun. The invention further reduces the free air exposure to the internals of the firearm, which holds the lubrication inside longer. The components are quickly removable within a matter of seconds so that the firearm may be utilized when needed.

The present invention also reduces the chances of accidental firing of a firearm by protecting the trigger. While the invention covers the trigger and the end of the barrel, it is quickly removable for use in the field.

DETAILED DESCRIPTION

Figure 1:
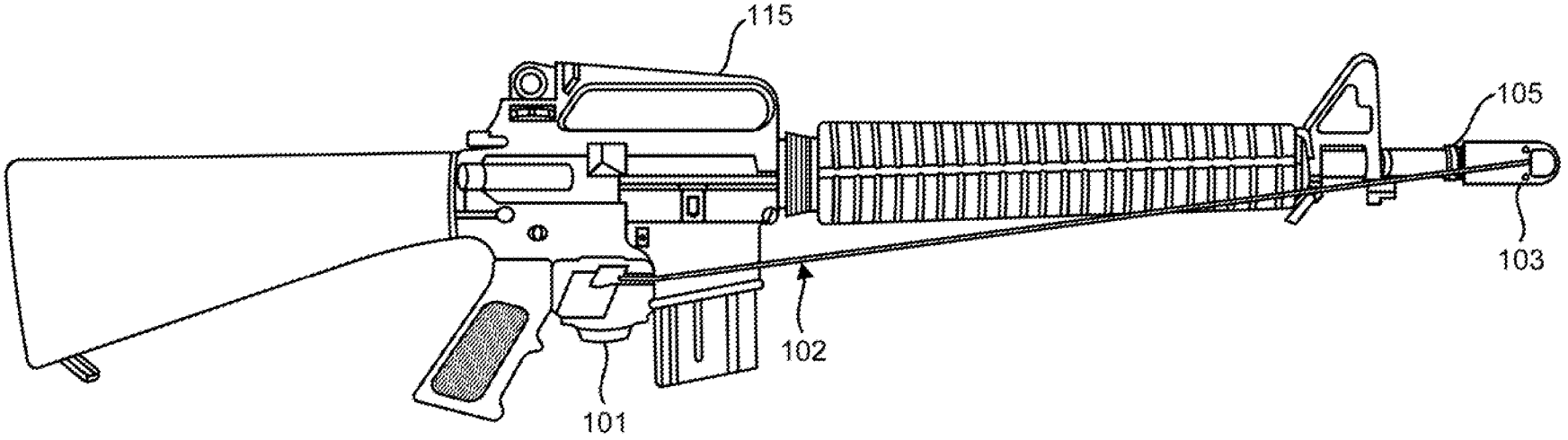
FIG. 1 is a side view of the firearm barrel and internals saver attached to a firearm.
Figure 2:
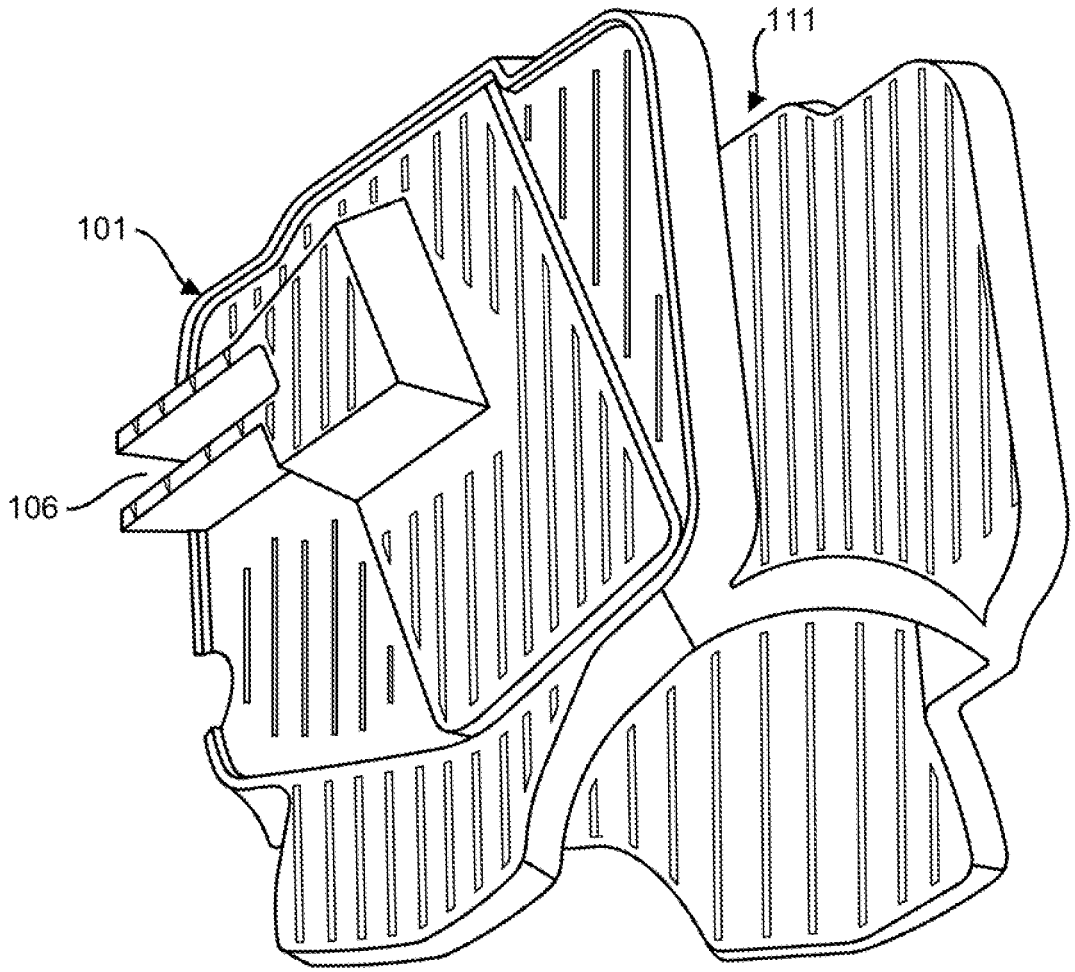
FIG. 2 is a perspective view of the trigger cover.

The present invention provides a firearm barrel and internals saver to accommodate a firearm. To use the invention, a user starts by clipping the trigger cover 101 onto the trigger guard of a firearm, such as an Armalite Rifle. The two elastic connective members 102, one on each side of the firearm, connect the trigger cover 101 and the barrel cover 103. The user can stretch the connective members 102 from the trigger cover 101 toward the end of the barrel furthest from the trigger 105. Once the connective members 102 are outstretched, the barrel cover 103 can be placed over the end of the barrel of the firearm 105. The elastic nature of the connective members 102 hold the trigger cover 101 and barrel cover 103 onto the firearm.

To remove the firearm barrel and internals saver, a user can pull the barrel cover 103 off the end of the barrel of the firearm 105. The trigger cover 101 can then be unclipped and removed from the trigger guard. The process can also be reversed wherein the user unclips the trigger cover 101 first and then removes the barrel cover 103. This process can be done quickly and easily which is ideal as the firearm may need to be available for use on short notice.

Figure 8:
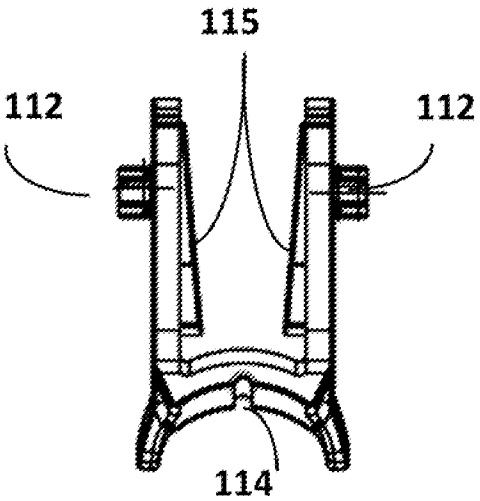
FIG. 8 shows a perspective view of an alternate embodiment of a barrel cover.
Figure 7:
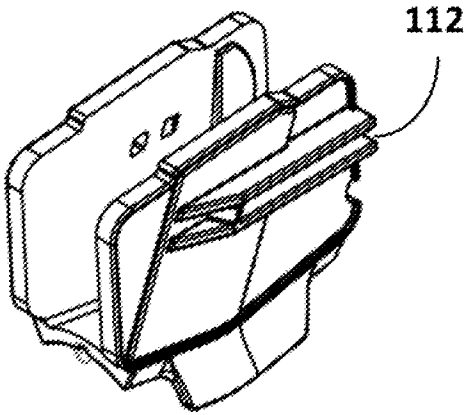
FIG. 7 is a perspective view of an alternate embodiment of a barrel cover.
Figure 6:
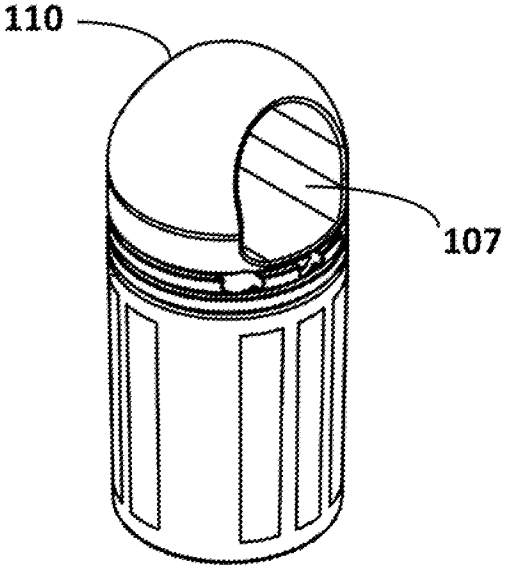
FIG. 6 is a perspective view of an alternate embodiment of a barrel cover.

In one embodiment, the trigger cover may have opposing sides having inner and outer surfaces, each side comprising a channel 112 (see FIG. 7) through which the connective member passes to thereby orient the connective member toward the barrel cover when the trigger cover and barrel cover are on a firearm as shown in FIG. 1. In addition, the opposing side may have inner surfaces comprising a taper 115 as shown in FIG. 8 to hold the trigger cover to the trigger guard of a firearm. In one embodiment, the trigger cover further has a recessed channel 114 (see FIG. 8) which decreases the thickness of the bottom of the cover to allow the sides of the trigger cover to flex with respect to each other. The bottom portions of the sides may be squeezed together which will cause the upper portions of the sides to move away from each other. This action can cooperate with the tapers 115 to disengage the trigger cover from the trigger guard of the firearm.

Figure 3:
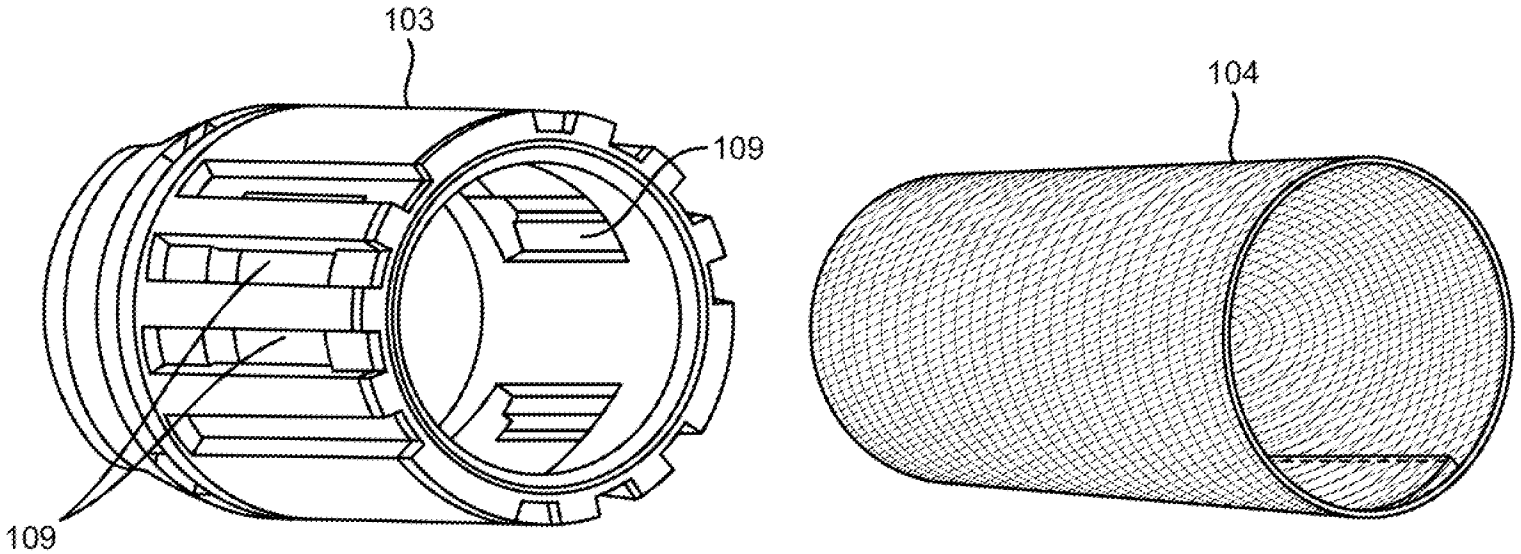
FIG. 3 is a perspective views of the barrel cover and an optional internal waterproof material.
Figure 4:
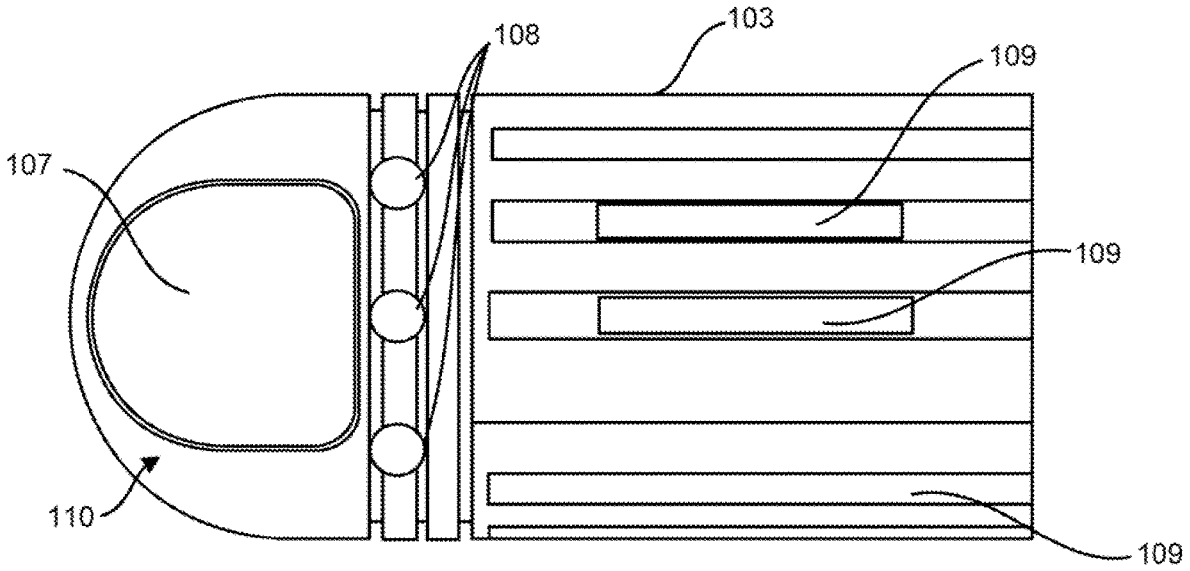
FIG. 4 is a side view of a barrel cover.
Figure 5:
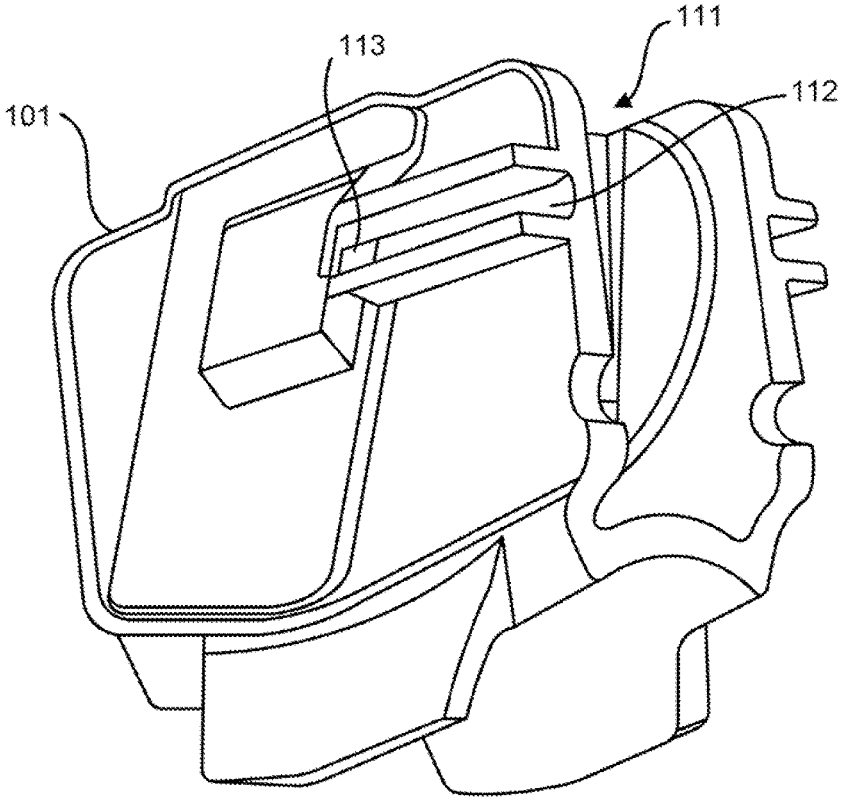
FIG. 5 is a perspective view of an alternate embodiment of a trigger cover.

In one embodiment, the connective members 102 are comprised of elastic, but the connective members may be comprised of any suitable material. The trigger cover 101 may be comprised of a molded piece of kydex, plastic or silicon or a similar hard, moldable, material, or any other suitable material. Further, while the trigger cover 101 is shown as a single piece in the drawings, the trigger cover 101 may be comprised of multiple components. While the barrel cover 103 is comprised of a durable material, such as kydex, it may also have an optional waterproof liner 104 as shown in FIG. 3, that may be comprised of any material that functions to keep debris, dust, and foreign objects out of the barrel of the firearm. As shown in FIG. 4, the barrel cover 103 may also have vents 109 to dissipate heat if it is placed on a recently discharged firearm barrel. The distal tip 110 may also have one or more holes 108 which may be used to either pass connect the connective members 102 as further shown in FIG. 1. There may be a single connective member that passes through one of the holes with each end attached to an opposite side of the trigger cover. Alternatively, there may be a connective member on each side which is secure to barrel cover 103 by forming a knot after the end passes through a hole 108. The distal tip 100 may also form an enclosed hole 107 operable to allow the barrel cover to be pulled off the tip of a firearm barrel.

Those of skill in the art will understand that various details of the invention may be changed without departing from the spirit and scope of the invention. Furthermore, the foregoing description is for illustration only, and not for the purpose of limitation, the invention being defined by the claims.

All references cited in this specification are incorporated herein by reference to the extent that they supplement, explain, provide a background for or teach methodology or techniques employed herein.

What is claimed is:

1. A firearm barrel and internals saver comprising:

a trigger cover configured to fit over a trigger guard of a firearm in a shape surrounding a bottom surface and side surfaces of the trigger guard, comprising:

opposing outer sides, each outer side comprising an elongated channel having upper and lower surfaces extending along the outer side such that a connective member may pass between the upper and lower surfaces to thereby orient the connective member toward the barrel cover when the trigger cover and barrel cover are on a firearm, and opposing engaging surfaces operable to cover the trigger guard and a concave bottom surface having formed therein a recessed channel equidistant from the opposing outer sides operable to allow the sides of the trigger cover to flex with respect to each other to thereby allow resilient attachment of the trigger cover to the firearm, a cylindrical barrel cover configured to accommodate a barrel of a firearm, the barrel having an axis, comprising:

a first annular end distal from the trigger guard and a second annular end closer to the trigger guard, an interior surface, a cylindrical outer surface, a plurality of radially disposed vents between the interior surface and cylindrical outer surface, a waterproof liner comprising an interior surface such that it abuts the barrel when the barrel cover is mounted on the barrel, and that extends between the first annular end and the second annular end of the cylindrical barrel cover, a distal tip forming an enclosed hole operable to allow the barrel cover to be pulled off the tip of a firearm barrel, wherein the hole in the barrel cover is perpendicular to the axis of the barrel and beyond the end of the barrel when positioned on the firearm barrel;

first and second elastic connective members each having one end attached to the trigger cover and another end attached to the barrel cover and positioned between the upper and lower surfaces of at least one of the elongated channels on an opposing side to thereby orient the connective members toward the barrel cover when the trigger cover and barrel cover are on a firearm; and wherein the first and second elastic connective members are sufficiently elastic such that, when the trigger cover is attached to the trigger guard of a firearm, the first and second elastic connective members can be pulled to position the barrel cover on or off the tip of the firearm barrel.

2. The firearm barrel and internals saver of claim 1 wherein the trigger cover further comprises:

opposing sides having inner and outer surfaces, and wherein the inner opposing engaging surfaces comprise a taper to hold the trigger cover to the trigger guard of a firearm.

3. The firearm barrel and internals saver of claim 1 wherein the trigger cover comprises kydex.

4. The firearm barrel and internals saver of claim 1 wherein the barrel cover comprises kydex.

5. A method of using a firearm barrel and internals saver, comprising:

providing a firearm, comprising:

a trigger guard;

a barrel having an axis;

providing a trigger cover configured to accommodate the trigger guard and shaped to surround a bottom surface and side surfaces of the trigger guard, comprising:

opposing outer sides, each outer side comprising an elongated channel having upper and lower surfaces extending along the outer side such that a connective member may pass between the upper and lower surfaces to thereby orient the connective member toward a barrel cover when the trigger cover and barrel cover are on a firearm, and a trigger guard engaging surface;

opposing trigger guard exterior surfaces; and a concave bottom surface having formed therein a recessed channel equidistant from the opposing outer sides operable to allow the sides of the trigger cover to flex with respect to each other to thereby allow resilient attachment of the trigger cover to the firearm, providing a cylindrical barrel cover configured to accommodate the barrel, the barrel having an axis, comprising:

a first annular end distal from the trigger guard and a second annular end closer to the trigger guard, an interior barrel engaging surface;

a cylindrical outer surface;

a waterproof liner comprising an interior surface such that it abuts the barrel when the barrel cover is mounted on the barrel, and that extends between the first annular end and the second annular end of the cylindrical barrel cover, a distal tip forming an enclosed hole operable to allow the barrel cover to be pulled off the tip of a firearm barrel, wherein the hole in the barrel cover is perpendicular to the axis of the barrel and beyond the end of the barrel when positioned on the firearm barrel;

a plurality of radially disposed vents between the interior surface and the cylindrical outer surface;

providing first and second connective members each having one end attached to the trigger cover and another end attached to the barrel cover, wherein:

each connective member is attachable to the trigger cover by the first end by passing between the upper and lower surfaces of at least one of the elongated channels and to the barrel cover by the second end; and attaching the barrel cover to the barrel; and wherein the first and second elastic connective members are sufficiently elastic such that, when the trigger cover is attached to the trigger guard of a firearm, the first and second elastic connective members can be pulled to position the barrel cover on or off the tip of the firearm barrel.

6. The method of using a firearm barrel and internals saver of claim 5 wherein the trigger cover comprises kydex.

7. The method of using a firearm barrel and internals saver of claim 5 wherein the barrel cover comprises kydex.

* * * * *